US005692245A

United States Patent [19]

Reuben

[11] Patent Number: 5,692,245

[45] **Date of Patent: *Dec. 2, 1997**

[54] THIN DOWN-FILL INNER LINING FABRIC AND METHOD OF MANUFACTURE

[76] Inventor: Ronnie Reuben, c/o Fabco Trading Corp. 8355 Labarre, Montreal, Quebec, Canada, H4P 2S5

[ * ] Notice: The term of this patent shall not extend beyond the expiration date of Pat. No. 5,408,700.

[21] Appl. No.: 770,006

[22] Filed: Dec. 19, 1996

[51] Int. Cl.[6] ..... A41D 27/02

[52] U.S. Cl. ..... 2/243.1; 2/69; 2/69.5; 2/97; 2/272; 112/420; 428/72; 428/76; 428/102; 428/220; 428/74

[58] Field of Search ..... 2/97, 243.1, 272, 2/69.5, 69, 267, 268, 108, 85, 93; 223/47; 112/402, 439, 440, 404, 420; 428/68, 71, 72, 74, 76, 102, 220, 6

[56] References Cited

U.S. PATENT DOCUMENTS

| | | | |
|---|---|---|---|
| 1,371,754 | 3/1921 | Gilcrest | 2/97 |
| 1,421,131 | 6/1922 | Abrams | 2/92 |
| 1,569,955 | 1/1926 | Falter | 428/102 |
| 2,702,387 | 2/1955 | Wenzel | 2/97 |
| 3,199,481 | 8/1965 | Handwerker | 112/420 |
| 3,541,620 | 11/1970 | Chapuis | 5/343 |
| 3,584,323 | 6/1971 | Worley | 2/69.5 |
| 3,837,021 | 9/1974 | Sellers et al. | 112/420 |
| 4,514,455 | 4/1985 | Hwang | 428/198 |
| 4,535,017 | 8/1985 | Kuckein et al. | 428/77 |
| 4,716,598 | 1/1988 | Bertram | 2/97 |

FOREIGN PATENT DOCUMENTS

| | | | |
|---|---|---|---|
| 13572 | 10/1928 | Austria | 2/97 |
| 861993 | 11/1940 | France | 2/97 |
| 478887 | 3/1953 | Italy | 2/97 |

*Primary Examiner*—Amy B. Vanatta
*Attorney, Agent, or Firm*—Swabey Ogilvy Renault; Guy J. Houle

[57] ABSTRACT

A thermally insulated down-fill fabric of reduced thickness and having a down-fill composition. A patterned envelope is formed and defines a pouch in which down or a down-fill composition is inserted and distributed substantially evenly within the envelope. The envelope is then compressed and stitch seams are formed to define a quilt pattern of closely spaced stitch lines to reduce the loft of the down-fill composition by about twice the normal loft thereof. This procedure is repeated over the entire envelope whereby the fabric has at least half the thickness of the normal loft of the down-fill composition.

7 Claims, 3 Drawing Sheets

THIN DOWN-FILL INNER LINING FABRIC AND METHOD OF MANUFACTURE

TECHNICAL FIELD

The present invention relates to a thermally insulated fabric having a down-fill composition wherein the composition is compressed to reduce the loft of the down-fill by at least twice the normal loft of the down-fill whereby the fabric may be used in the manufacture of articles of apparel, bedspreads, sofas, draperies and other articles.

BACKGROUND ART

It is well known in the art that down or down compositions provide excellent thermal insulating values for the reason that the down is very fluffy and traps air which provides excellent insulation. However, because down or compositions thereof is very fluffy, when used as an inner lining for articles of clothing it provides a very puffy appearance. The thicker the fluff in the inner lining, the more insulating value is achieved and the article of clothing is puffier. This has a disadvantage in that the article of clothing becomes very large and disproportionate to the person wearing the article of clothing. For this reason down is utilized in only certain articles of apparel and not others where its insulating value may be desirable.

Because of the above existing problems, other insulating materials are used as inner linings, such as synthetic fibers. However, synthetic fibers cannot replace the excellent thermal insulation properties of down which is a natural product. Also, down is not a polluting agent when released in the environment as are resinous fiber materials.

Another problem with down-fill lining is that the down can be displaced within the lining and congregate in certain portions thereof where it then provides increased insulation while in other portions of the lining the insulating value is reduced. A still further disadvantage of using down-fill interlining, wherein the interlining has a body covering portion as well as arm portions secured thereto, is that the padding or insulation in the armpit region of the inner lining doubles in thickness due to the fact that when the article of clothing is worn the arm extends against the body, thus providing double thickness insulation under the armpit. This makes it very uncomfortable to the wearer and restricts arm movement to some degree.

I have found that the quilt stitch pattern which is used to compress the down is pleasing to the eye and therefore outerwear can be fabricated with the quilt stitch visible on the outer surface of the article of apparel. The compressed down-fill fabric can also be used to fabricate bedspreads, covering materials for furniture, draperies and many other articles. Furthermore, the cross-stitched patterns may vary in size and design and in some applications could have surface areas of 1.5 inches to 2 inches, but preferably less than 1.5 inches.

SUMMARY OF INVENTION

It is a feature of the present invention to provide an improved thermally insulated fabric formed with down-fill or down-fill compositions and which substantially overcomes the above-mentioned disadvantages of the prior art.

Another feature of the present invention is to provide a thermally insulated fabric having a down-fill or down-fill composition disposed within a pouch forming an inner lining and wherein the composition is substantially evenly distributed throughout the pouch and retained therein in a compressed form whereby the loft of the down-fill composition is reduced by at least twice the normal loft thereof to produce an insulating lining of reduced thickness.

A still further feature of the present invention is to provide a thermally insulated fabric having a down-fill composition and wherein the fabric has a quilt stitching throughout the surface area thereof and wherein the surface area of the quilt patterns is no greater than 1.5 square inch whereby the loft of the down-fill composition is reduced by at least twice the normal loft thereof.

According to the above features, from a broad aspect, the present invention provides a thermally insulated down-fill fabric comprising a pouch formed by an outer fabric layer and an inner fabric layer. A down-fill composition is disposed inside the pouch and distributed substantially evenly therein. A cross-stitched pattern interconnects the outer and inner fabric layers and defined by closely spaced patterns of stitched lines. The stitched lines are arranged to maintain the loft of the down-fill composition compressed by about twice the normal loft of the composition to produce a thermally insulating fabric having at least half the thickness of the normal loft of the down-fill composition. The cross-stitched pattern defines a plurality of small delineated patterned areas of approximately 1.5 square inch or less over the surface area of the pouch. The fabric has an insulating value which is reduced in the range of from about 10 to 20% of that of normal uncompressed down-fill materials.

According to a still further broad aspect of the present invention, there is provided a thermally insulated article of apparel formed by a down-fill composition fabric. The down-fill composition has an outer fabric layer and an inner fabric layer forming a pattern pouch. A down-fill composition is positioned inside the pouch and distributed substantially evenly therein. A cross-stitched pattern interconnects the outer and inner fabric layers and is defined by closely spaced patterns of stitched lines. The stitched lines are arranged to maintain the loft of the down-fill composition compressed by about twice the normal loft of the composition to produce a fabric having about half the thickness of the normal loft of the down-fill composition. The cross-stitched pattern defines a plurality of small delineated quilt patterned areas of about 2.0 square inch or less over the entire surface area of the pouch and dependent on the thickness of the down-fill material when uncompressed whereby to maintain the down-fill composition compressed by at least twice the normal loft of the down-fill composition.

BRIEF DESCRIPTION OF DRAWINGS

A preferred embodiment of the present invention will now be described with reference to the examples thereof illustrated in the accompanying drawings in which.

DESCRIPTION OF PREFERRED EMBODIMENTS

Figure 1:
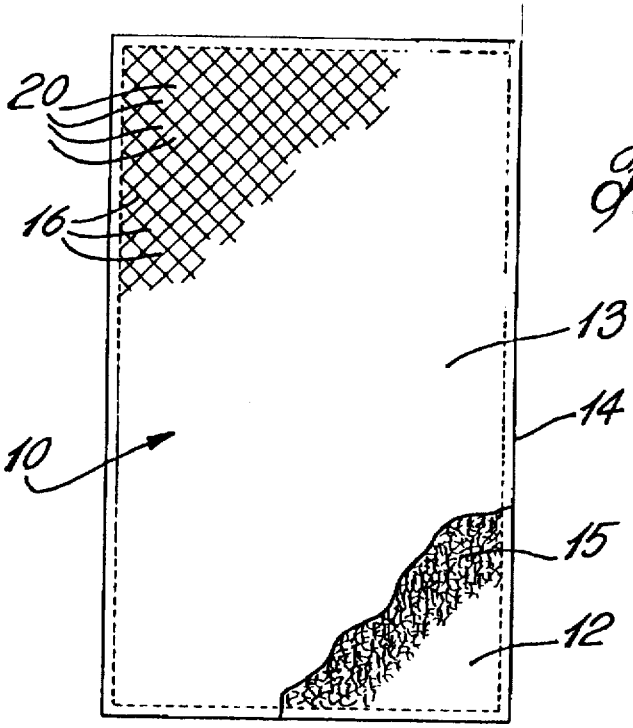
FIG. 1 is a plan view showing a down-fill composition patterned fabric sheet formed in accordance with the present invention.

Referring now to the drawings, and more particularly to FIG. 1, there is shown a thermally insulated fabric sheet 10 constructed in accordance with the present invention. The patterned sheet 10 is formed by an inner fabric layer of material 12 and an outer fabric layer of material 13 which are connected together by stitching along the outer peripheral edge 14 thereof. The fabric materials 12 and 13 may be any suitable material depending on the use of the sheet 10. The patterned lining fabric sheet 10 is filled with a predetermined quantity of down-fill material 15 or compositions thereof which is distributed substantially evenly therein by manipulation. A quilt stitch pattern 16 interconnects the outer and inner lining fabric 13 and 12 and maintains the down-fill composition 15 substantially evenly distributed and compressed within the pouch.

Figure 5A:
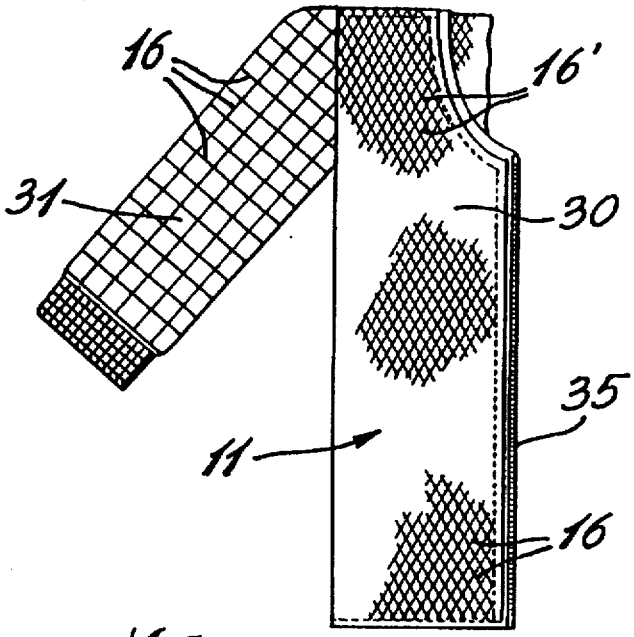
FIG. 5A is a fragmented plan view showing an article of apparel having a down-fill composition and constructed in accordance with the present invention wherein the body portion and arm portions of the article have different thermal insulating values achieved by quilting patterns of different sizes.
Figure 4D:
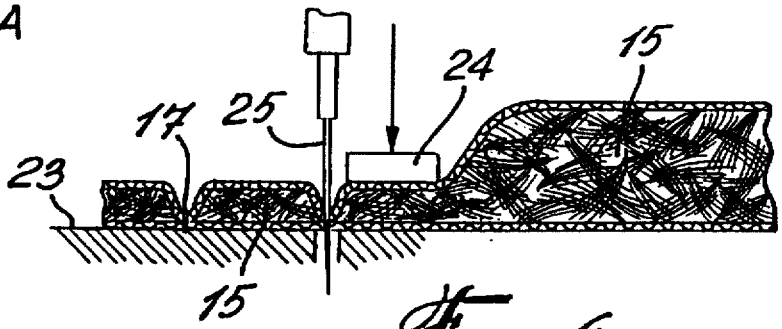

As shown in FIG. 1, the quilt stitching pattern 16 is defined by closely spaced patterns of stitch lines 17 arranged to compress the loft of the down-fill composition 15 to produce thermally insulated article of apparel 11 as shown in FIG. 5A, which has a thickness that is about half the thickness of the normal loft of the down-fill composition.

Figure 2:
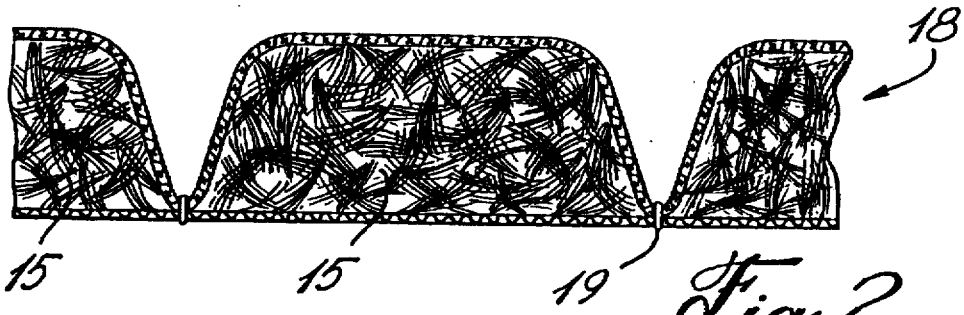
Fig. 2 (PRIOR ART)
FIG. 2 is a section view showing a down-fill insulating fabric sheet formed in accordance with the prior art.

FIG. 2 shows a cross-section of a down-fill insulating material 18 of the type well known in the prior art. Because the down-fill 15 is known to have superior thermally insulating properties when expanded, due to the fact that air is trapped within the down, it has been common in the trade not to compress the down but rather to package it loose so that it assumes its normal loft. For this reason, any stitching 19 is spaced apart large distances to prevent compressing the down-fill material 15. As previously discussed, this bulky fabric is usually utilized as an inner lining and provides other inconveniences in articles of apparel, and for this reason its application has some restraints.

Figure 3:
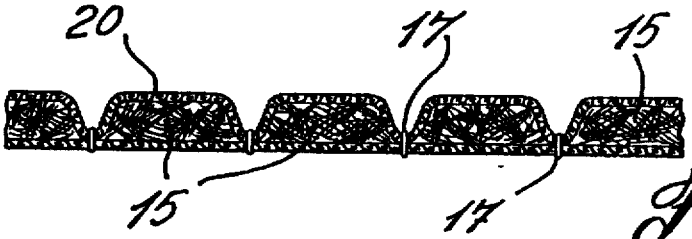
FIG. 3 is a similar view of the sheet of FIG. 2, but formed in accordance with the present invention showing the substantial reduction in thickness in the insulated down-filled sheet.

We have found that by quilting this type of material with closely spaced stitch lines, as shown in FIG. 1, the thickness of the inner insulating lining can be greatly reduced to at least twice the thickness of the prior art down-fill insulating materials. By compressing the down-fill material 15, as shown in FIG. 3, to about twice the normal loft, the thermal insulating value thereof is reduced in the range of 10 to 20 percent. However, such reduction has been found acceptable due to the great reduction in thickness of the lining and due to the fact that the material has many more applications in the fabrication of articles of apparel, such as outerwear, rainwear, all types of winter coats, furniture coverings, bedspreads, drapes, etc. As shown in FIG. 3, the quilt stitched pattern 16 is very closely spaced and defines quilt patterns having surface areas 20 which are about up to 1.5 square inch.

Figure 4A:
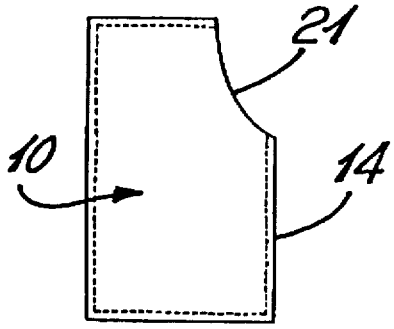
FIGS. 4A to 4D are sequential schematics illustrating the manner in which the down-fill composition fabric of the present invention is made.
Figure 4B:
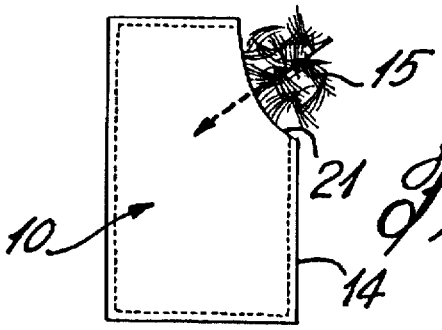
Figure 4C:
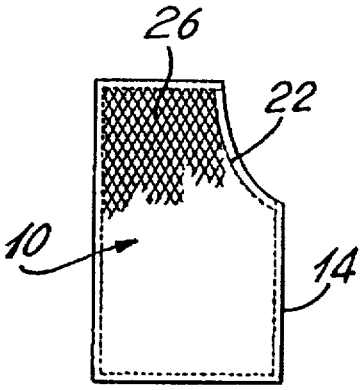

Referring now additionally to FIGS. 4A to 4D, there will be described the method of making such an insulating fabric piece for an article of apparel. A patterned envelope 10 is formed by sewing inner and outer patterned fabric layers together. However, in doing so a seam opening 21 is provided in the outer peripheral edge 14, as shown in FIG. 4A. The down-fill composition material 15 is then introduced in the seam opening 21, as shown in FIG. 4B, by suitable means such as by a hose (not shown) having an air pressure therein. Once this material is introduced in the pouch the seam opening 21 is stitched, as illustrated by stitch lines 22 in FIG. 4C. The down is then distributed substantially evenly by manipulating the pouch. The spreading of the composition is achieved by the operator who moves the pouch around and feels by hand the material when substantially evenly distributed therein. The pouch 10 is then placed on a backing surface 23 where means, such as a pressure element 24, which may also be the hand of a person, applies pressure in a predetermined area of the pouch. At the same time a stitching needle 25 is brought down on the pouch to form stitch lines 17. One of the fabric layers 12 or 13 is premarked with chalk lines 26 (see FIG. 4C) to indicate the location of these stitch lines 17.

It is pointed out that the thickness of the insulating inner lining or article of apparel 11 is predetermined by the quantity of down-fill material placed within the pouches 10 and the spacing of the stitch lines 17. Hence the surface areas 20 of the quilt stitch pattern 16 are dependent on these parameters. It has been found that the down-fill composition should be compressed to about twice the normal loft of the down or composition thereof, as illustrated in FIGS. 2 and 3, in order to achieve a substantial reduction in the thickness of the material and adequate thermal insulation.

Figure 6:
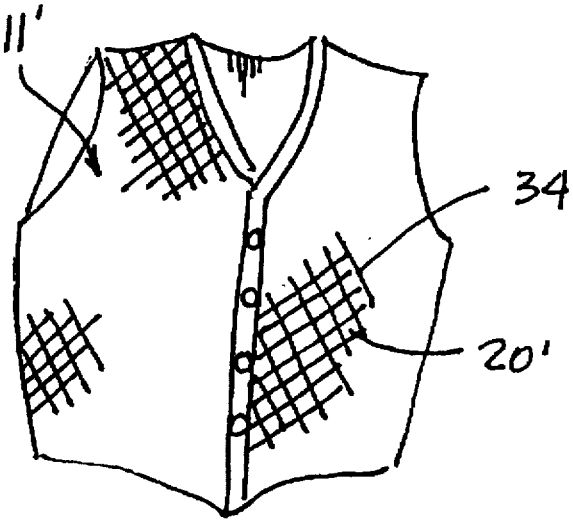
FIG. 6 is a perspective view showing a thermally insulated article of apparel constructed in accordance with the present invention.

Referring now to FIG. 5A, there is shown the thermally insulating article of apparel 11 wherein the body portion 30 thereof and arm portions 31 are provided with quilt stitch patterns 16' and 16" defining surface areas 20 of the patterns of different sizes. Accordingly, the body portion or arm portions are of different thickness. They may also have a lesser quantity of down-fill composition per square inch area therein. The inner lining or article of apparel 11 may therefore have different thermal insulating values in portions thereof. Also the different thicknesses of this material provide a designer with insulated materials having different looks to fabricate outerwear which is pleasing to the eye, as shown in FIG. 6. Different quilt sizes also provide more freedom of movement and a less bulky appearance to articles of apparel. Another advantage is that the thermally insulated article of apparels 11 and 11", as shown in FIG. 6, have a decorative appearance provided by the type and color of material utilized or the patterns 16', 16" may be of different designs as well as sizes.

Figure 5B:
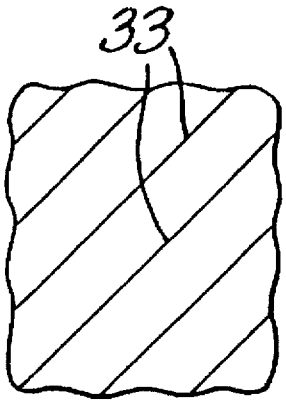
FIGS. 5B and 5C illustrate quilt patterns of different shapes.
Figure 5C:
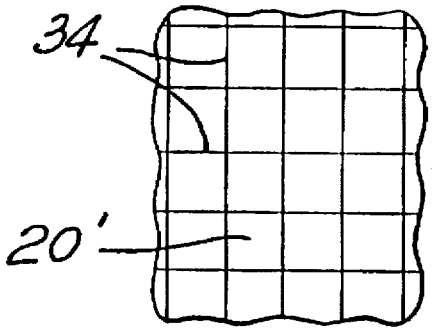

FIG. 5B illustrates a different quilt pattern which is constituted by a plurality of closely spaced parallel stitch seams 33 extending throughout the body portion 30 and arm portions 31. FIG. 5C illustrates a still further quilt stitch pattern 34 defined by transverse stitch lines forming square surface areas 20' which are approximately 1.5 square inch or less and distributed over the entire surface area of the article of apparel 11. As shown in FIG. 5A, the quilt stitch pattern 16' is of diamond shape whereas the pattern 16" in the arm portion is of square shape. A fastener 35 may also be secured along a securing outer edge of the thermally insulating article of apparel 11 and many other functional articles or design articles such as pockets, collars, etc.

Referring now to FIG. 6, there is shown a thermally insulated article of apparel 11', herein a vest, which is formed of pattern pouch sections having a down-fill material therein compressed in accordance with the present invention. By providing closely spaced stitched patterns, as previously described, the advantages of thinness and variable thermal insulation in various portions of the article are achieved.

It is pointed out that when the down-fill composition is in greater quantities producing a thick normal loft, the quilt stitch pattern may have a surface area of about 2.0 inches or less, while still obtaining a substantial reduction in loft.

It is within the ambit of the present invention to cover any obvious modifications of the preferred embodiment of the present invention described herein, provided such modifications fall within the scope of the appended claims.

I claim:

1. A thermally insulated down-fill fabric comprising a pouch formed by an outer fabric layer and an inner fabric layer, a down-fill composition inside said pouch and distributed substantially evenly therein, a cross-stitched pattern interconnecting said outer and inner fabric layers and defined by closely spaced patterns of stitched lines, said stitched lines being arranged to maintain the loft of said down-fill composition compressed by about twice the normal loft of said composition to produce a thermally insulating fabric having at least half the thickness of the normal loft of said down-fill composition, said cross-stitched pattern defining a plurality of small delineated patterned areas of approximately 1.5 square inch or less over the surface area of said pouch, said fabric having an insulating value which is reduced in the range of from about 10% to 20% of that of normal compressed down-fill materials.

2. A fabric as claimed in claim 1 wherein said fabric is used as an article of apparel for outer wear.

3. A fabric as claimed in claim 2 wherein said delineated patterned areas are of different sizes.

4. A fabric as claimed in claim 2 wherein said delineated quilt patterned areas are not more than 1 square inch.

5. A fabric as claimed in claim 1 wherein said cross-stitched pattern defines a plurality of closely spaced parallel stitched seams over the entire surface area of said pouch.

6. A thermally insulated article of apparel formed by a down-fill composition fabric, said down-fill composition fabric having an outer fabric layer and an inner fabric layer forming a patterned pouch, a down-fill composition inside said pouch and distributed substantially evenly therein, a cross-stitched pattern interconnecting said outer and inner fabric layers and defined by closely spaced patterns of stitched lines, said stitched lines being arranged to maintain the loft of said down-fill composition compressed by about twice the normal loft of said composition to produce a fabric having about half the thickness of the normal loft of said down-fill composition, said cross-stitched pattern defining a plurality of small delineated quilt patterned areas of about 1.5 square inch or less over the entire surface area of said pouch and dependent on the thickness of said down-fill material when uncompressed whereby to maintain said down-fill composition compressed by at least twice the normal loft of said down-fill composition.

7. A thermally insulated article of apparel formed by a down-fill composition fabric, said down-fill composition fabric having an outer fabric layer and an inner fabric layer forming a patterned pouch, a down-fill composition inside said pouch and distributed substantially evenly therein, a cross-stitched pattern interconnecting said outer and inner fabric layers and defined by closely spaced patterns of stitched lines, said stitched lines being arranged to maintain the loft of said down-fill composition compressed by about twice the normal loft of said composition to produce a fabric having about half the thickness of the normal loft of said down-fill composition, said cross-stitched pattern defining a plurality of small delineated quilt patterned areas of about 2.0 square inch or less over the entire surface area of said pouch and dependent on the thickness of said down-fill material when uncompressed whereby to maintain said down-fill composition compressed by at least twice the normal loft of said down-fill composition.

* * * * *